US011585192B2

(12) United States Patent
Tonkin et al.

(10) Patent No.: US 11,585,192 B2
(45) Date of Patent: Feb. 21, 2023

(54) METHOD AND SYSTEM FOR REACTIVELY DEFINING VALVE SETTINGS

(71) Applicant: Schlumberger Technology Corporation, Sugar Land, TX (US)

(72) Inventors: Trevor Graham Tonkin, Abingdon (GB); Shingo Watanabe, Houston, TX (US); Matthew Worthington, Houston, TX (US); Mohamed Osman Mahgoub Ahmed, Abingdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/250,784

(22) PCT Filed: Sep. 11, 2018

(86) PCT No.: PCT/US2018/050315
§ 371 (c)(1),
(2) Date: Mar. 3, 2021

(87) PCT Pub. No.: WO2020/055379
PCT Pub. Date: Mar. 19, 2020

(65) Prior Publication Data

US 2021/0198985 A1 Jul. 1, 2021

(51) Int. Cl.
*E21B 34/16* (2006.01)
*E21B 43/12* (2006.01)
*E21B 47/00* (2012.01)

(52) U.S. Cl.
CPC ..... *E21B 43/12* (2013.01); *E21B 34/16* (2013.01); *E21B 47/00* (2013.01)

(58) Field of Classification Search
CPC ..... E21B 34/16; E21B 43/00; E21B 43/12; E21B 47/00
See application file for complete search history.

(56) References Cited

U.S. PATENT DOCUMENTS

| | | | | |
|---|---|---|---|---|
| 9,816,353 | B2 * | 11/2017 | Rashid | E21B 43/12 |
| 9,864,353 | B2 | 1/2018 | Tonkin et al. | |
| 11,326,443 | B2 * | 5/2022 | Watanabe | E21B 43/00 |
| 2007/0179766 | A1 * | 8/2007 | Cullick | E21B 43/00 703/10 |
| 2007/0198223 | A1 * | 8/2007 | Ella | G06Q 50/06 702/182 |

(Continued)

OTHER PUBLICATIONS

Yeten, B., "Optimum Deployment of Nonconventional Wells," Dissertation for the Degree of Doctor of Philosophy, Stanford University, Jun. 2003 [relieved from internet on Mar. 3, 2021]. URL: pangea.stanford.edu/ERE/pdf/pereports/PhD/Yeten03.pdf.

(Continued)

*Primary Examiner* — Daniel P Stephenson

(57) ABSTRACT

A method includes obtaining a reservoir model for a subsurface reservoir, identifying a current state of the subsurface reservoir using the reservoir model, and a computer processor selecting an optimization function from multiple optimization functions according to the current state of the reservoir to obtain a selected optimization function. The method further includes the computer processor calculating valve positions of physical devices using the selected optimization function. The valve positions are implemented.

20 Claims, 7 Drawing Sheets

(56) References Cited

U.S. PATENT DOCUMENTS

| | | | | |
|---|---|---|---|---|
| 2007/0271077 | A1 | 11/2007 | Kosmala et al. | |
| 2014/0262235 | A1* | 9/2014 | Rashid | E21B 43/12 166/250.01 |
| 2016/0273315 | A1 | 9/2016 | Carvajal et al. | |
| 2021/0198985 | A1* | 7/2021 | Tonkin | E21B 47/00 |
| 2021/0238971 | A1* | 8/2021 | Crumpton | E21B 43/12 |
| 2021/0334433 | A1* | 10/2021 | Taieb | G06F 30/20 |

OTHER PUBLICATIONS

International Search Report and Written Opinion dated Oct. 26, 2018 in International Application No. PCT/US2018/050315.

* cited by examiner

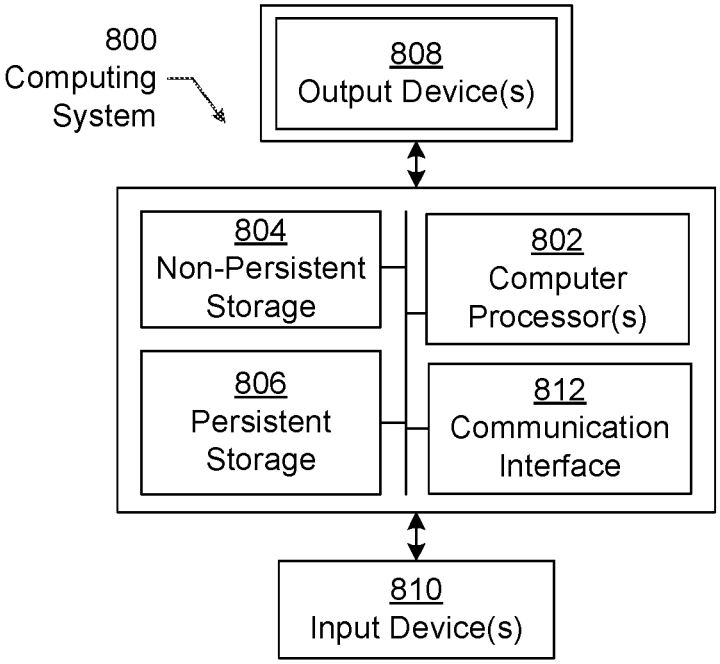
FIG. 8.1
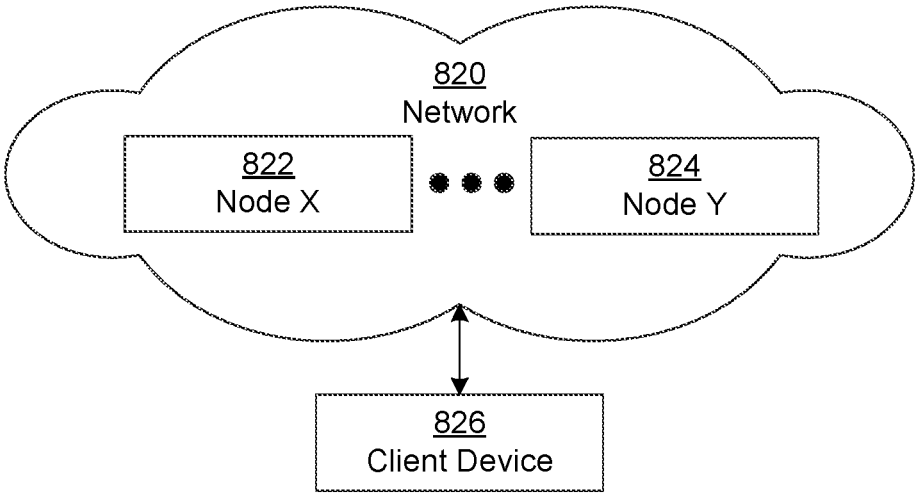
FIG. 8.2

METHOD AND SYSTEM FOR REACTIVELY DEFINING VALVE SETTINGS

BACKGROUND

Computer systems are used for a variety of technological fields in order to model various aspects of a technology. For example, one use of computer systems is to model underground formations and model the extraction of hydrocarbons. Specifically, sensors at the oilfield gather large volumes of data. The sensors send the large volumes of data to the computer system. Through the various techniques of mathematical modeling and simulations, the computer system attempts to create an optimal design for extracting hydrocarbons. A challenge exists to manage the amount of data that the computer system receives, the execution times, and the various timing requirements for returning a result. Often, the computer system is inefficient when performing the modeling and generating a result. Inefficiency causes delay or more computing resources to be used.

SUMMARY

In general, in one aspect, one or more embodiments are directed to reactively defining completion device settings. One or more embodiments include obtaining a reservoir model for a subsurface reservoir, identifying a current state of the subsurface reservoir using the reservoir model, and a computer processor selecting an optimization function from multiple optimization functions according to the current state of the reservoir to obtain a selected optimization function. One or more embodiments further include the computer processor calculating valve positions of physical devices using the selected optimization function. The valve positions are implemented.

Other aspects of the invention will be apparent from the following description and the appended claims.

BRIEF DESCRIPTION OF DRAWINGS

FIGS. 8.1 and 8.2 show computing systems in accordance with disclosed embodiments.

DETAILED DESCRIPTION

Figure 1:
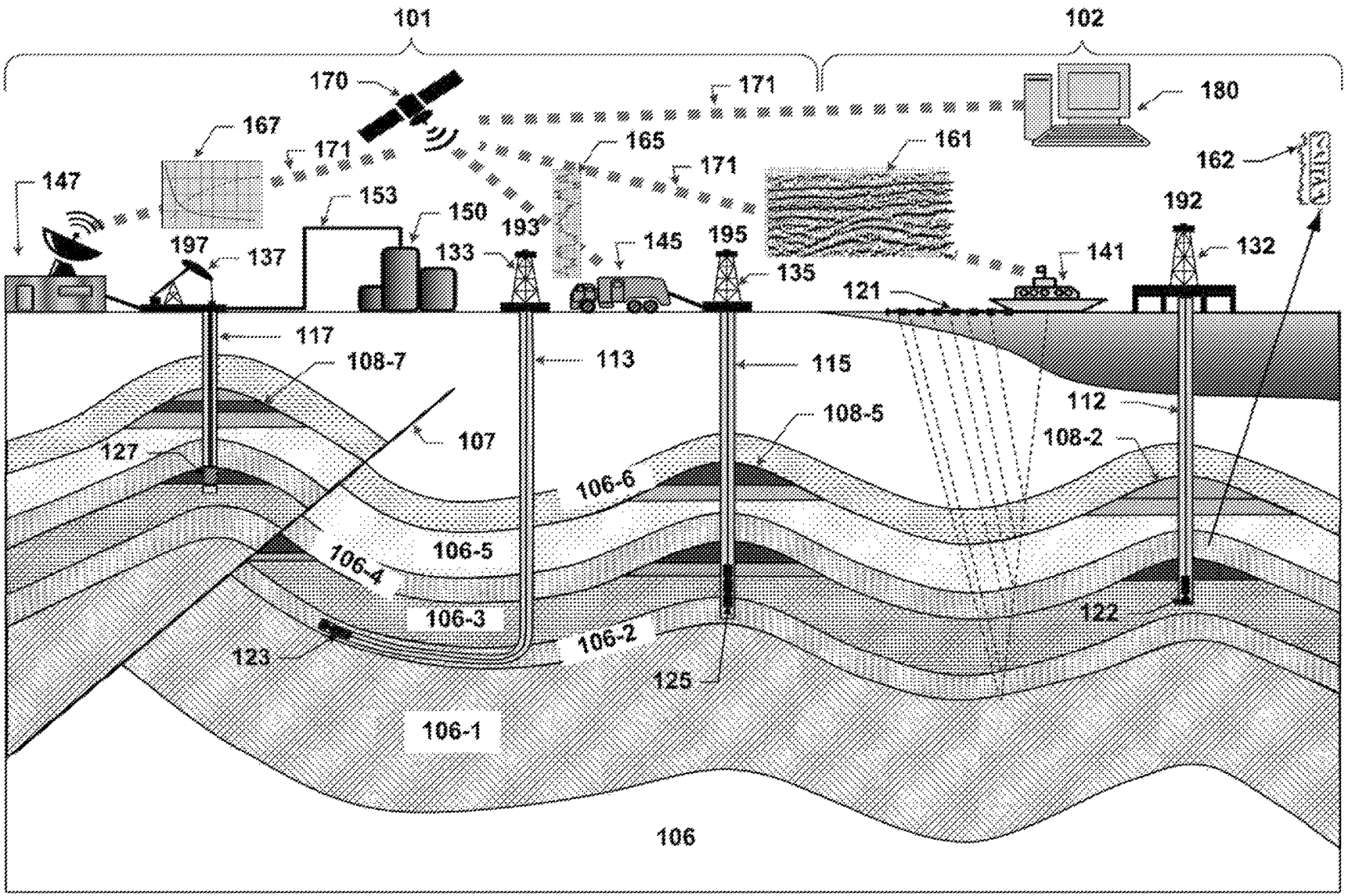
FIG. 1 shows a diagram of a system in accordance with disclosed embodiments.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments are directed to reactively defining valve settings to improve the efficiency of a computer system. In other words, reactively defining valve settings is the determination and implementation of response valve settings to events that occur at the wellbore. The valve settings are the positions of the valve in the wellbore to maximize production at the wellbore. In one or more embodiments, multiple different optimization functions are defined. Each optimization function corresponds to a state of the wellbore. Thus, when an event occurs at the wellbore, the current state of the wellbore is determined. Based on the current state, the corresponding optimization function is selected and used to reactively define the valve setting matching the state.

One or more embodiments may be performed during a simulation stage of simulating the wellbore. For example, reactively defining valve setting may be performed in response to simulated events of the wellbore. The simulated events may reflect a simulated state. By reactively defining the valve setting versus using forward modeling, the solution space is reduced. In other words, whereas in forward modeling multiple states and corresponding solutions are explored by the computer system, the solution space is reduced to the solution for the current state when reactively defining the valve settings.

One or more embodiments may be performed during physical production and completion operations of the wellbore. In other words, rather than using a reservoir simulator, the events may be detected events that are detected using actual physical measurements at the wellbore. In such a scenario, the response valve settings may be implemented in the reservoir.

FIG. 1 depicts a schematic view, partially in cross section, of an onshore field (101) and an offshore field (102) in which one or more embodiments may be implemented. In one or more embodiments, one or more of the modules and elements shown in FIG. 1 may be omitted, repeated, and/or substituted. Accordingly, embodiments should not be considered limited to the specific arrangement of modules shown in FIG. 1.

As shown in FIG. 1, the fields (101), (102) includes a geologic sedimentary basin (106), wellsite systems (192), (193), (195), (197), wellbores (112), (113), (115), (117), data acquisition tools (121), (123), (125), (127), surface units (141), (145), (147), well rigs (132), (133), (135), production equipment (137), surface storage tanks (150), production pipelines (153), and an exploration and production (E&P) computer system (180) connected to the data acquisition tools (121), (123), (125), (127), through communication links (171) managed by a communication relay (170).

The geologic sedimentary basin (106) contains subterranean formations. As shown in FIG. 1, the subterranean formations may include several geological layers (106-1 through 106-6). As shown, the formation may include a basement layer (106-1), one or more shale layers (106-2, 106-4, 106-6), a limestone layer (106-3), a sandstone layer (106-5), and any other geological layer. A fault plane (107) may extend through the formations. In particular, the geologic sedimentary basin includes rock formations and may include at least one reservoir including fluids, for example the sandstone layer (106-5). In one or more embodiments, the rock formations include at least one seal rock, for example, the shale layer (106-6), which may act as a top seal. In one or more embodiments, the rock formations may include at least one source rock, for example the shale layer (106-4), which may act as a hydrocarbon generation source. The geologic sedimentary basin (106) may further contain hydrocarbon or other fluids accumulations associated with certain features of the subsurface formations. For example, accumulations (108-2), (108-5), and (108-7) associated with structural high areas of the reservoir layer (106-5) and containing gas, oil, water or any combination of these fluids.

In one or more embodiments, data acquisition tools (121), (123), (125), and (127), are positioned at various locations along the field (101) or field (102) for collecting data from the subterranean formations of the geologic sedimentary basin (106), referred to as survey or logging operations. In particular, various data acquisition tools are adapted to measure the formation and detect the physical properties of the rocks, subsurface formations, fluids contained within the rock matrix and the geological structures of the formation. For example, data plots (161), (162), (165), and (167) are depicted along the fields (101) and (102) to demonstrate the data generated by the data acquisition tools. Specifically, the static data plot (161) is a seismic two-way response time. Static data plot (162) is core sample data measured from a core sample of any of subterranean formations (106-1 to 106-6). Static data plot (165) is a logging trace, referred to as a well log. Production decline curve or graph (167) is a dynamic data plot of the fluid flow rate over time. Other data may also be collected, such as historical data, analyst user inputs, economic information, and/or other measurement data and other parameters of interest.

The acquisition of data shown in FIG. 1 may be performed at various stages of planning a well. For example, during early exploration stages, seismic data (161) may be gathered from the surface to identify possible locations of hydrocarbons. The seismic data may be gathered using a seismic source that generates a controlled amount of seismic energy. In other words, the seismic source and corresponding sensors (121) are an example of a data acquisition tool. An example of seismic data acquisition tool is a seismic acquisition vessel (141) that generates and sends seismic waves below the surface of the earth. Sensors (121) and other equipment located at the field may include functionality to detect the resulting raw seismic signal and transmit raw seismic data to a surface unit (141). The resulting raw seismic data may include effects of seismic wave reflecting from the subterranean formations (106-1 to 106-6).

After gathering the seismic data and analyzing the seismic data, additional data acquisition tools may be employed to gather additional data. Data acquisition may be performed at various stages in the process. The data acquisition and corresponding analysis may be used to determine where and how to perform drilling, production, and completion operations to gather downhole hydrocarbons from the field. Generally, survey operations, wellbore operations and production operations are referred to as field operations of the field (101) or (102). These field operations may be performed as directed by the surface units (141), (145), (147). For example, the field operation equipment may be controlled by a field operation control signal that is sent from the surface unit.

Further as shown in FIG. 1, the fields (101) and (102) include one or more wellsite systems (192), (193), (195), and (197). A wellsite system is associated with a rig or a production equipment, a wellbore, and other wellsite equipment configured to perform wellbore operations, such as logging, drilling, fracturing, production, or other applicable operations. For example, the wellsite system (192) is associated with a rig (132), a wellbore (112), and drilling equipment to perform drilling operation (122). In one or more embodiments, a wellsite system may be connected to a production equipment. For example, the well system (197) is connected to the surface storage tank (150) through the fluids transport pipeline (153).

In one or more embodiments, the surface units (141), (145), and (147), are operatively coupled to the data acquisition tools (121), (123), (125), (127), and/or the wellsite systems (192), (193), (195), and (197). In particular, the surface unit is configured to send commands to the data acquisition tools and/or the wellsite systems and to receive data therefrom. In one or more embodiments, the surface units may be located at the wellsite system and/or remote locations. The surface units may be provided with computer facilities (e.g., an E&P computer system) for receiving, storing, processing, and/or analyzing data from the data acquisition tools, the wellsite systems, and/or other parts of the field (101) or (102). The surface unit may also be provided with, or have functionality for actuating, mechanisms of the wellsite system components. The surface unit may then send command signals to the wellsite system components in response to data received, stored, processed, and/or analyzed, for example, to control and/or optimize various field operations described above.

In one or more embodiments, the surface units (141), (145), and (147) are communicatively coupled to the E&P computer system (180) via the communication links (171). In one or more embodiments, the communication between the surface units and the E&P computer system may be managed through a communication relay (170). For example, a satellite, tower antenna or any other type of communication relay may be used to gather data from multiple surface units and transfer the data to a remote E&P computer system for further analysis. Generally, the E&P computer system is configured to analyze, model, control, optimize, or perform management tasks of the aforementioned field operations based on the data provided from the surface unit. In one or more embodiments, the E&P computer system (180) is provided with functionality for manipulating and analyzing the data, such as analyzing seismic data to determine locations of hydrocarbons in the geologic sedimentary basin (106) or performing simulation, planning, and optimization of exploration and production operations of the wellsite system. In one or more embodiments, the results generated by the E&P computer system may be displayed for user to view the results in a two-dimensional (2D) display, three-dimensional (3D) display, or other suitable displays. Although the surface units are shown as separate from the E&P computer system in FIG. 1, in other examples, the surface unit and the E&P computer system may also be combined. The E&P computer system and/or surface unit may correspond to a computing system, such as the computing system shown in FIGS. 8.1 and 8.2 and described below.

Figure 2:
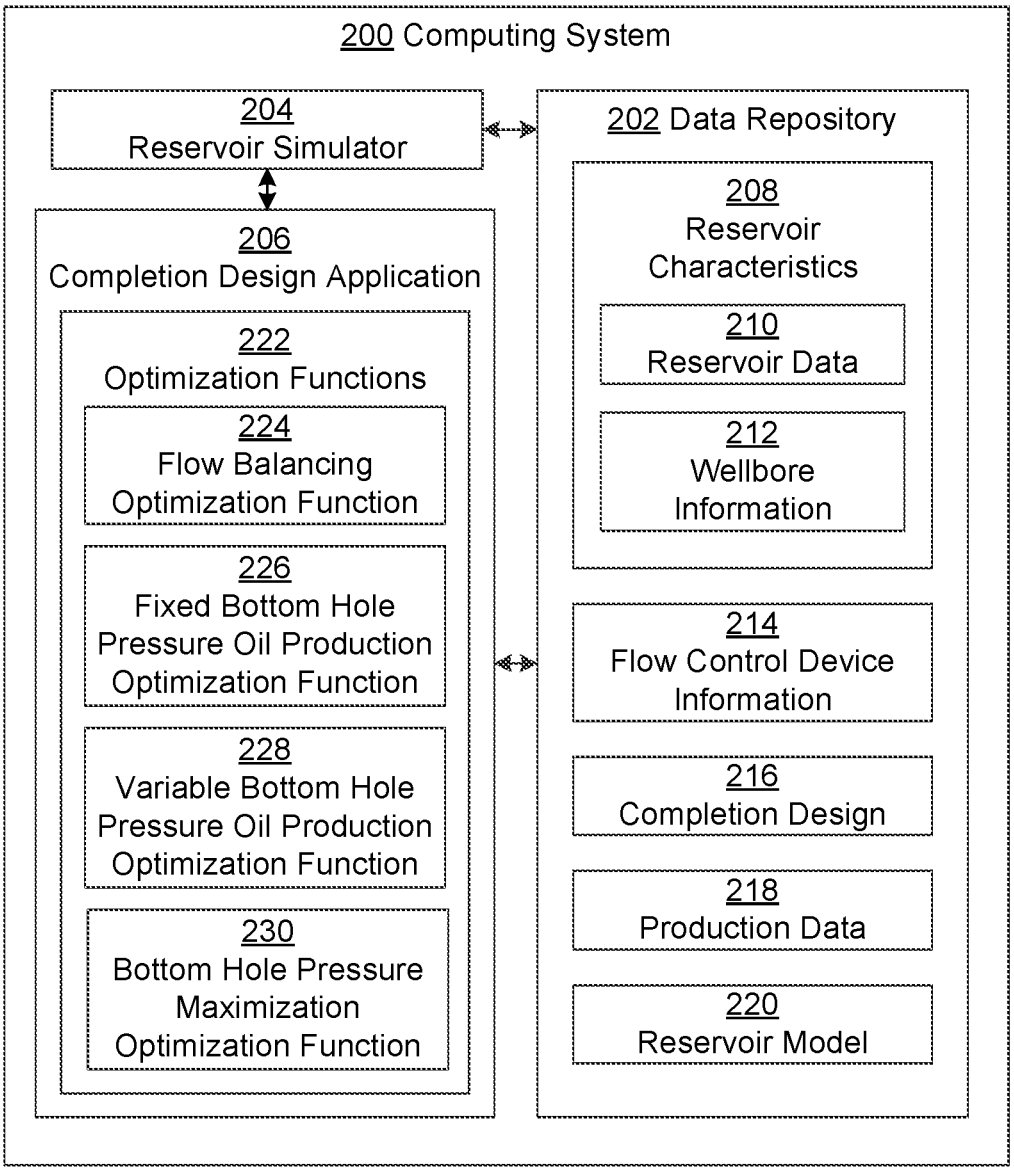
FIG. 2 shows a diagram of a system in accordance with disclosed embodiments.

FIG. 2 shows a computing system (200), which may be the same as computing system (180) in FIG. 1. The hardware components of computing system (200) is described in further detail below and in FIGS. 8.1 and 8.2. The computing system includes a data repository (202), a reservoir simulator (204), and a completion design application (206). Each of these components is described below.

In one or more embodiments of the technology, the data repository (202) is any type of storage unit and/or device (e.g., a file system, database, collection of tables, physical memory, or any other storage mechanism) for storing data. The storage of data may be permanent, semi-permanent, or temporary (e.g., during execution of the completion design application (204)). Further, the data repository (202) may include multiple different storage units and/or devices. The multiple different storage units and/or devices may or may not be of the same type or located at the same physical site.

The data repository (202) includes functionality to store reservoir characteristics (208). The reservoir characteristics (208) is information about the subsurface formations from which hydrocarbons may be produced. The reservoir characteristics (208) may further include information about the wellbore. The reservoir characteristics (208) may be input for the reservoir model (206), discussed below. Reservoir characteristics (208) includes reservoir data (210) and wellbore information (212)

Reservoir data (210) is information about the subsurface formation. For example, the reservoir data (210) may include information about the physical properties of the subsurface formations, such as porosity, permeability, gamma ray logs, etc. that is gathered from the seismic and other sensors described above with reference to FIG. 1.

Wellbore information (212) is information describing the wellbore, such as the wellbore in FIG. 1. For example, wellbore information may include information about the geometry (e.g., shape) and trajectory (e.g., path) of the wellbore. One or more embodiments may be applied to a single lateral, multi-lateral, or multi-well configuration. Wellbore information (212) may also include information about the upstream devices connected to the wellbore for completion operations.

Continuing with the data repository (202), the data repository (202) includes functionality to store flow control device information (214), completion design (216), production data (218), and a reservoir model (220).

Flow control device information (214) is information describing flow control devices along the wellbore. The flow control devices may include fixed control devices and valves. Fixed control devices have a constant size opening that does not change over time. For example, the fixed control devices, may be passive inflow control devices (ICDs). A valve (i.e., flow control valve) has a variable size opening that may change over time. The size of the opening is adjustable as part of the valve settings. One or more embodiments define the valve settings for valves. In one or more embodiments, the flow control device information (214) includes constraints for the flow control devices. For example, the flow control device information may include a maximum and a minimum flowrate that can produce through the flow control device, a limitation on the pressure drop that the flow control device can tolerate without damage to the flow control device, a size of the maximum and minimum openings of the flow control device, and other information. The flow control device information (214) may be defined on a per flow control device basis or per group of flow control devices.

A completion design (216) is a specification of the configuration of physical equipment in the oilfield to extract hydrocarbons. For example, the completion design (216) may specify the packet positions, choking parameters, series of flow control valve settings, and other aspects of the completion design. Production data (218) is information about the volume, composition, velocity, and other aspects of the hydrocarbons produced from the wellbore. In one or more embodiments, the production data (218) is dependent on the completion design (216).

A reservoir model (220) is a model of an oilfield reservoir. In one or more embodiments, the reservoir model (220) is defined as a grid spanning a subsurface region. The grid may be a regular grid or irregular grid. Each location in the grid is a grid cell. The size of the grid cell is the scale at which the reservoir model models the subsurface formations with the reservoir. Each grid cell has physical properties defined for the grid cell. For example, the physical properties may be porosity, permeability, composition, or other properties. The reservoir model may further include information about fluid flow through the reservoir. The physical properties may be obtain using the oilfield equipment described above with reference to FIG. 1.

Continuing with FIG. 2, a reservoir simulator (204) is communicatively connected to the data repository (202). For example, the reservoir simulator (204) includes functionality to read, write, and store, directly or indirectly, data in the data repository (202). The reservoir simulator (204) includes functionality to simulate the flow of fluids through the subsurface formations and the wellbore. Specifically, the reservoir simulator (204) includes functionality to determine the amount of flow, composition, pressure, of fluids through the various rock formations and wellbore using the reservoir model (210). The reservoir simulator may operate through various timesteps, where each timestep represents a period of actual time (e.g., hour, day, week, etc.). In one or more embodiments, the reservoir simulator is configured to provide values on at least a per flow control device basis. For example, the reservoir simulator may be configured to predict values representing amount and/or rates of gas, oil, and water flowing through the respective flow control device. The reservoir simulator may further be configured to identify the respective pressures through the flow control device. Other outputs of the reservoir simulator (204) may exist and be used.

A completion design application (206) is communicatively connected to the data repository (202) and the reservoir simulator (204). For example, the completion design application (206) includes functionality to read, write, and store, directly or indirectly, data in the data repository (202), provide inputs to the reservoir simulator and use outputs of the reservoir simulator (204). The completion design application (206) includes functionality to generate a completion design (216) based on the output of the reservoir simulator. In one or more embodiments, the completion design application (206) includes multiple optimization functions (222). Each optimization function (222) distinctly corresponds to a state of the wellbore. A state is defined by the mutable attributes of the wellbore that change over time. For example, the attributes may include pressure at various flow control devices, whether the pressure at various flow control devices is above or below a certain value, whether water cut exists at one or more flow control devices, whether the bottom hole pressure limit is reached, whether the gas oil ratio (GOR) is below a defined value, or other attribute or combination of attributes. Thus, the state is dynamic over time and may change as hydrocarbons are produced from the reservoir.

Continuing with the optimization functions (222), an optimization function includes an objective function (not shown) and one or more linear or nonlinear constraint functions. The objective function may be a minimization function or a maximization function. The optimization functions (222) have different objective functions and constrain functions that are specific to the state of the wellbore.

In one or more embodiments, the optimization functions (222) include a flow balancing optimization function (224), fixed bottom hole pressure oil production optimization function (226), a variable bottom hole pressure oil production optimization function (228), and a bottom hole pressure maximization optimization function (230). The flow balancing optimization function (224) has an objective function to equalize the flow rates from each flow control device while maximizing oil production. Specifically, the flow balancing optimization function (224) has an objective function to minimize the sum of the errors between the idealized flowrate which has equal flow and calculated flowrates of the flow control devices. The calculated flowrates are the flowrates through each flow control device as determined by the reservoir simulator or measure and are based on the hydraulics of the well. The flow balancing optimization function may further be defined to maximize oil production while satisfying various device and well constraints.

The fixed bottom hole pressure oil production optimization function (226) and a variable bottom hole pressure oil production optimization function (228) have an objective function to maximize oil production. Further, such optimization functions do not have an objective to equalize the flowrates through the flow control devices. In other words, the flowrates may vary between flow control devices without considering the variance. The fixed bottom hole pressure optimization function (226) may correspond to a state in which the minimum bottom hole pressure is reached in the wellbore. Thus, the bottom hole pressure is set as a static value in the fixed bottom hole pressure optimization function (226).

The variable bottom hole pressure optimization function (228) may correspond to a state in which the minimum bottom hole pressure is reached in the wellbore and the bottom hole pressure may be increased, such as by using injection processes (e.g., gas injection). In such a scenario, the bottom hole pressure is a variable amount. For example, the variable bottom hole pressure optimization function (228) may be the same as the fixed bottom hole pressure optimization function (226) with an additional nonlinear constraint that changes the performance of the well. The additional nonlinear constraint may have an additional control variable of the liquid production rate.

The bottom hole pressure maximization optimization function (230) is defined to maximize oil production from the wellbore without considering flow balancing. The bottom hole pressure maximization optimization function (230) uses the maximum bottom hole pressure and corresponds to a state in which the GOR and the water cut limits have not been satisfied. In other words, the GOR and water cut is below a defined amount.

While FIGS. 1 and 2 show a configuration of components, other configurations may be used without departing from the scope of the invention. For example, various components may be combined to create a single component. As another example, the functionality performed by a single component may be performed by two or more components.

Figure 3:
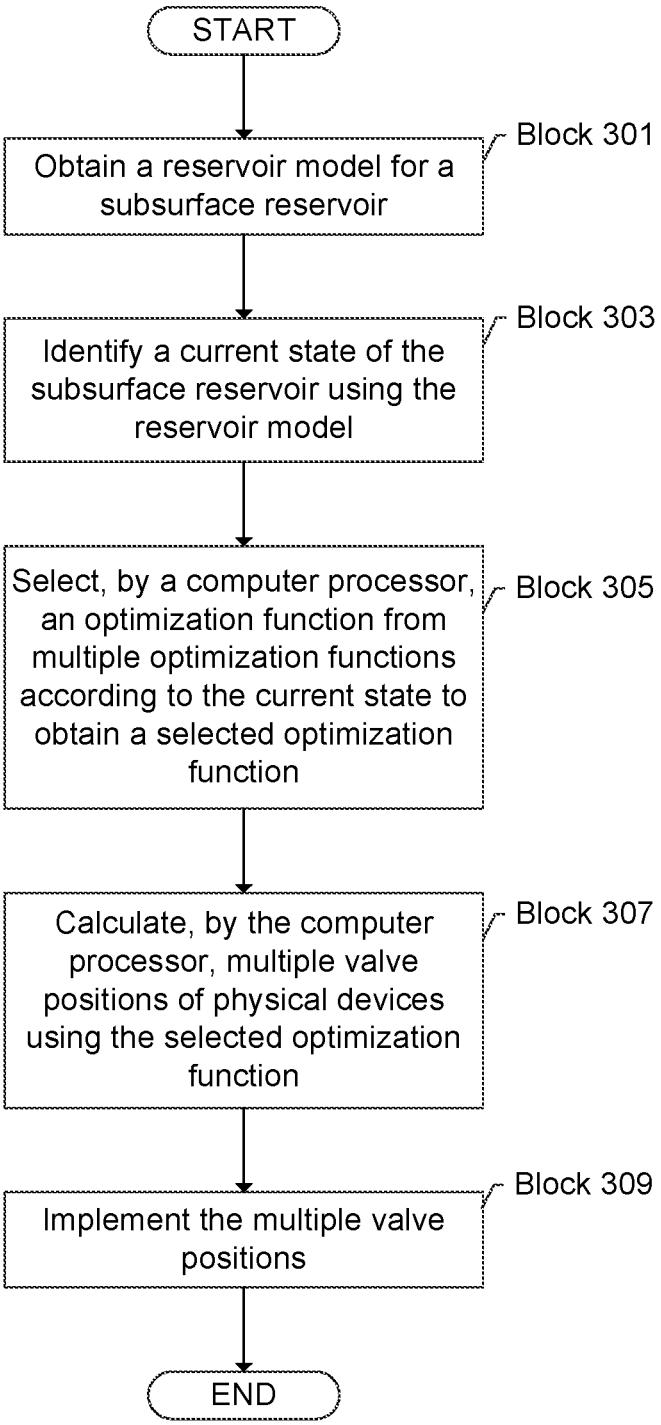
FIG. 3 shows a flowchart in accordance with disclosed embodiments.
Figure 4:
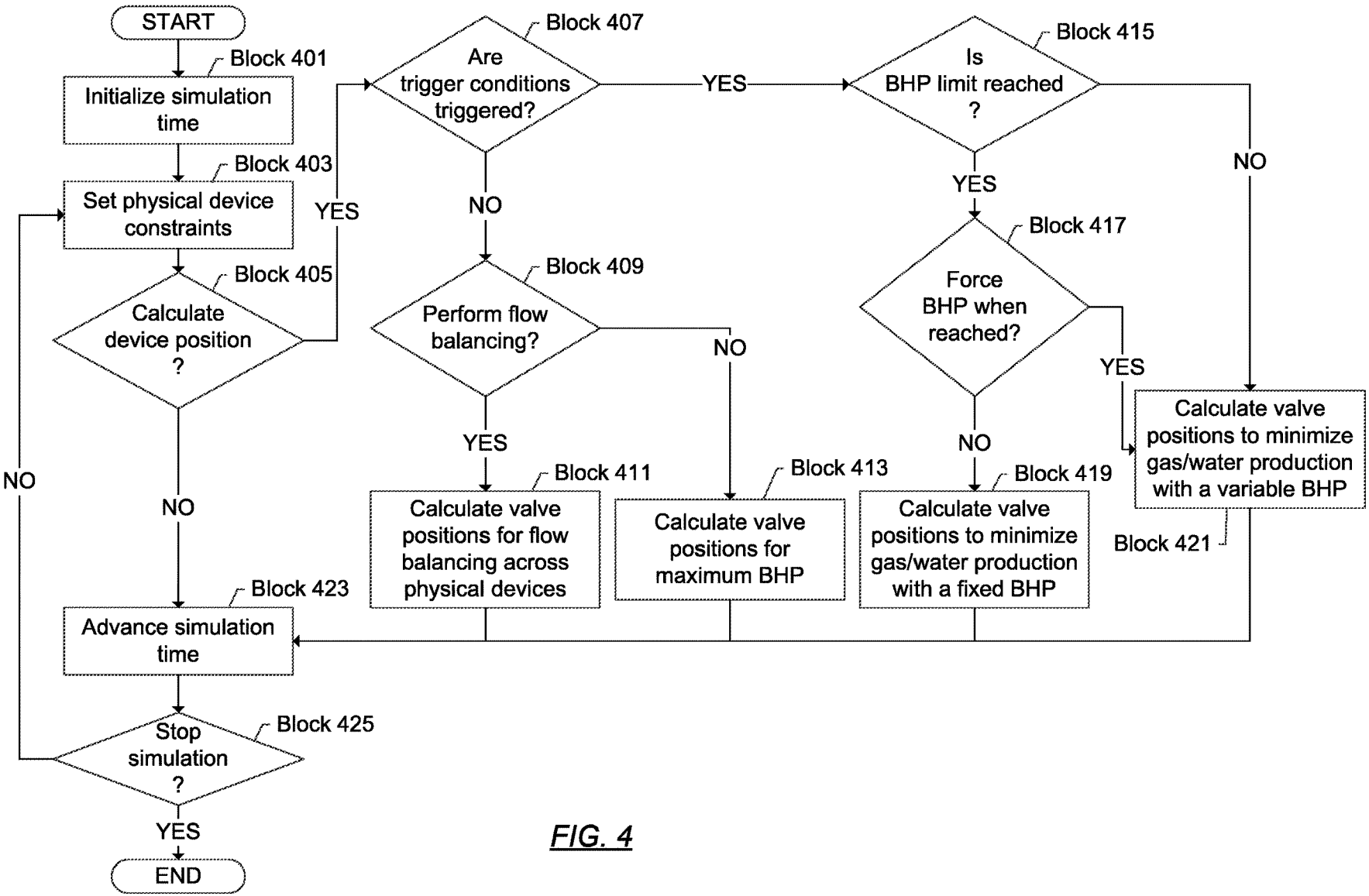
FIG. 4 shows a flowchart in accordance with disclosed embodiments.

FIG. 3 and FIG. 4 show flowcharts in accordance with one or more embodiments. While the various steps in these flowcharts are presented and described sequentially, one of ordinary skill will appreciate that at least some of the blocks may be executed in different orders, may be combined or omitted, and at least some of the blocks may be executed in parallel. Furthermore, the blocks may be performed actively or passively. For example, some blocks may be performed using polling or be interrupt driven in accordance with one or more embodiments. By way of an example, determination blocks may not require a processor to process an instruction unless an interrupt is received to signify that condition exists in accordance with one or more embodiments. As another example, determination blocks may be performed by performing a test, such as checking a data value to test whether the value is consistent with the tested condition in accordance with one or more embodiments.

Turning to FIG. 3, FIG. 3 shows a flowchart in accordance with one or more embodiments of the disclosure. In Block 301, a reservoir model for a subsurface reservoir is obtained. The reservoir model may be generated or provided as input from another source. The reservoir model may be generated based on the reservoir characteristics and information obtained from the data acquisition tools deployed across the fields as depicted in FIG. 1 above.

In Block 303, a current state of the subsurface reservoir is identified using the reservoir model. Based on the reservoir model, the reservoir simulator simulates the flow of fluids through the reservoir. For example, the reservoir simulator may traverse the grid of the reservoir model to update the properties of the grid cells according to the current properties of the grid cells. For example, the reservoir simulator may determine the composition and pressures at the grid cells. The reservoir simulator may further simulate the flow of fluid into and through the wellbore. Accordingly, the reservoir simulator calculates the physical property values at various locations along the wellbore. The physical property values are the values that the reservoir simulator simulates to be measured values in an actual well. From the various physical property values, the state of the reservoir is determined. For example, the physical property values may be compared to ranges and thresholds to identify whether the physical property values are in the range or satisfy the threshold. Based on whether the physical property values are in the range or satisfy the threshold, the state of the reservoir is determined. For example, the state may be that the GOR is greater than a threshold.

In Block 305, a computer processor selects an optimization function based on the current state. The optimization function is selected by comparing the current state of the reservoir to the states assigned to the optimization functions. The optimization function that is assigned a state matching the current state of the reservoir is selected.

In Block 307, the computer processor calculates multiple valve positions of physical flow control devices using the selected optimization function. In other words, the computer processor executes a linear or non-linear programming algorithm to analyze the search space and identify a solution satisfying the objective function and the constraint functions of the optimization function. At least some of the values may be calculated by the reservoir simulator. For example, the reservoir simulator may calculate the water, gas, oil, and total liquid at the flow control devices for particular valve settings of the flow control devices. Reservoir simulators calculate phase flows by solving flow equations at given well, initial and boundary conditions. The duration of the solution in the simulated time is usually user controlled or dictated by the difficulty to reach numerical convergence. The duration of the solution is often ten to thirty days.

In Block 309, the multiple valve positions are implemented. Implementing the multiple valve positions may be performed by using the settings of the valve positions in the next timestep of the simulations. In other words, the next one or more timesteps of the simulations may use the settings of the valve positions as the value of the openings of the flow control valves.

As another example, implementing the multiple valve positions may be physically performed in the oilfield. In such a scenario, the physical flow control valve devices may be adjusted in the oilfield to match the valve position settings.

Turning to FIG. 4, FIG. 4 shows a flowchart in accordance with one or more embodiments. Specifically, FIG. 4 shows a detailed version of FIG. 3. In one or more embodiments, one or more of the steps of FIG. 4 may be omitted. For example, some of the decision blocks and corresponding operational blocks may be removed.

In Block 401, simulation time is initialized. Specifically, the reservoir model is obtained, and the reservoir simulator starts executing using the reservoir model through various timesteps. The size of the timestep may be determined by the reservoir simulator, set by default, or selected by a user.

In Block 403, physical device constraints are set. Some of the physical device constraints may be static constraints of the physical device that are the same for each timestep, while other constraints may vary between timesteps. For example, the well target liquid rate and well/valve constraints may be set in Block 403. In one or more embodiments, solving the optimization functions is performed to comply with the target liquid production rate for the well subject to constraints for both the well and flow control device level. The constraints for the well may include constraints for bottom hole pressure, tubing head pressure, maximum GOR, maximum water cut, and minimum liquid rate. The constraints per device may include constraints for maximum GOR, maximum water cut, minimum liquid rate, maximum liquid rate, maximum pressure drop, maximum drawdown, minimum opening, maximum opening, and maximum change in the opening. One or more constraints may be added and/or omitted without departing from the scope described herein.

In Block 405, a determination is made whether to calculate the device position. For example, the user may set a flag to control the calculations such that the valve positions are not changed by the optimization. For example, the flag may be used to model inflow control devices. Likewise, a determination may be made not to calculate device positions for each timestep. In particular, continually changing the valve positions may be impractical. The determination of whether to calculate the device positions may be performed by checking a flag.

If a determination is made not to calculate the device positions, the flow advances to Block 423. In Block 423, the simulation time is advanced. In other words, the simulation time moves to the next timestep. In Block 425, a determination is made whether to stop the simulation. If a determination is made to stop the simulation, the flow proceeds to end. When the simulation is stopped, the results of the simulation may be used to generate a completion design. The completion design may be implemented in an actual field by configuring the flow control devices over time as specified by the completion design and determined by FIG. 4. If a determination is made not to stop the simulation, the flow may return to Block 403.

Returning to Block 405, if a determination is made to calculate the device position, the flow proceeds to Block 407. In Block 407, a determination is made whether the trigger conditions are triggered. For example, the trigger conditions may be a maximum value of GOR and water cut. In some embodiments, the determination is whether the trigger conditions have ever been triggered for the simulation. In other words, if any current or past timestep triggers the trigger conditions, then the trigger conditions are determined to be triggered for the current timestep in Block 407.

During the early stage of a simulation the values for the GOR and water cut may be such that an optimization of the flow control valve positions may not be appropriate. For example, the values of the GOR and water cut are low enough that breakthrough of the phases whose production to limit is not significant enough to curtail production because of either surface production rate constraints or the well control limitations. As another example, the flow control devices may have essentially the same value for the phases of interest and a unique solution to the problem does not exist. In the second example, the only effect that changing the positions of the flow control valves will be to change the pressure profile within the well.

In one or more embodiments, if any flow control device triggers the trigger condition, then the trigger conditions are determined triggered in Block 407. If the trigger conditions are not triggered, the flow proceeds to Block 409.

In Block 409, a determination is made whether to perform flow balancing. For example, the determination may be whether to perform flow balancing or whether to maximize the bottom hole pressure (BHP). If the determination is made to perform flow balancing, the flow proceeds to Block 411.

In Block 411, the valve positions are calculated for flow balancing across the physical devices. Specifically, the flow balancing optimization function is selected and solved to calculate the valve positions. The flow balancing is an attempt to equalize the sweep of the fluids in the well. The flow balancing may be based upon the total fluid rate at reservoir conditions, the liquid rate at reservoir conditions or the liquid rate at surface conditions. Constraints on individual flow control valves, such as max. pressure drop or max flow rate are considered when performing flow balancing. Thus, the balanced solution may not give the same flow rate for each flow control device but will rather be based upon a minimization of the sum of the imbalance for all the flow control valves.

Multiple methods may be used to attempt to equalize the sweep of fluids in the well. For example, strict equalizing of the flow rates at the inlet to each flow control valve may be performed. By way of another example, the flow rates at the inlet to each flow control valve may be proportionally set based upon the ratio of permeability thickness of the zone in the well flowing through the flow control valve to the sum of the permeability thicknesses for all the flow control valves in the well.

Returning to Block 409, if a determination is made not to perform flow balancing, the Block 413 may be performed. In Block 413, the valve positions for maximum BHP is calculated. Specifically, the bottom hole pressure maximization optimization function may be solved. For example, for highly heterogeneous wells in which the flow control valves produced from zones with widely different productivity indices, the flowing bottom hole pressure of the well may be maximized.

In Block 415, a determination is made whether the BHP limit is reached. The BHP limit is the minimum value of the bottom hole pressure. For example, the BHP limit may be reached based on depletion of the fluids in the reservoir. Without additional intervention, with the extraction resources from the well, the BHP is reduced.

For the calculation of the valve positions once the limit on the minim BHP for the well has been reached there are two alternative formulations of the problem in terms of the way in which the well constraints are applied.

In Block 417, a determination is made whether to force the BHP when the BHP limit is reached. For example, injection operations may be performed to force the BHP. If a determination is made not to force the BHP, then the valve positions to minimize gas and water production is performed using a fixed BHP in Block 419. The fixed BHP oil production optimization function is solved. For the fastest and most computationally efficient calculations the BHP limit can be directly applied to the well model as constraint so that the optimization only solves for the maximum flowrate that satisfies the valve constraints.

The optimization problem may be formulated to calculate the device settings. The device settings may be based on directly specified well constraints, control variables, and non-learning constraints. The directly specific well constraints include bottom hole pressure and/or tubing head pressure. The control variables include device settings. The non-linear constraints include at least one device fully open (if at least 2 open devices), and maximum liquid production rate. The various of the above constraints may be used in the formulation of the fixed BHP oil production optimization function.

If a determination is made to use the force BHP in Block 417 or if the BHP limit is not reached in Block 415, the flow may proceed to Block 421. In Block 421, the valve positions are calculated to minimize gas/water production with a variable BHP. The variable BHP oil production optimization function is solved. The variable BHP may be used to calculate the device settings. To calculate the device settings, the control variables may be device settings and liquid production rates. The liquid production rates may be calculated using various bottom hole pressures. The non-linear constraints may be that at least two devices are open.

Continuing with FIG. 4, once the device positions are determined in Block 411, Block 413, Block 419, and Block 421, the flow may proceed to Block 423 (discussed above).

The following are examples of optimization functions in accordance with one or more embodiments of the invention. Both the flow balancing and phase minimization calculations are formulated as an optimization problem which may be solved using a Non-Linear Programming (NLP) approach. The optimization functions may be represented using equations (1), (2), and (3)

$$\min f(x) \tag{1}$$

$$\text{s.t. } l_i \le x_i \le u_i \quad i=1, \ldots, n \tag{2}$$

$$g_j(x) \le 0 \quad j=1, \ldots, m \tag{3}$$

Equation (1) represents minimization of the objective function which is a function of the set fractional openings of the set of n flow control valves, x. The objective function is specific to the problem type (e.g., the type of optimization of FIG. 4, such as flow balancing or phase minimization). Equation (2) represents the set of linear constraints bounding the range of allowable fractional openings for each flow control valve between the minimum value, l, and the maximum value, u. Equation (3) represents the set of non-linear inequality constraints. The set of non-linear inequality constraints model the operational constraints for each flow control device, such as maximum pressure drop, maximum flow rate, etc., and operation constraints for the well, such as minimum bottom hole pressure and minimum tubing head pressure.

The flow balancing objective function calculates the sum of the errors of the deviations from the balanced flow rate for all the flow control devices. The flow balancing objective function is shown in equations (4), (5), and (6).

$$f(x) = \sum_{i=0}^{n} \epsilon_i^2 \tag{4}$$

$$L_i = \frac{L}{n} \tag{5}$$

$$\epsilon_i = \frac{(L_i^t - L_i)}{L_i^t} \tag{6}$$

where:

L=Liquid production rate for the well $L_i^t$=Balanced liquid production rate for a device $L_i$=Liquid production rate for a device $\epsilon_i$=Relative imbalance for the device Equation (4) represents the objective function which is a function of the set fractional openings of the set of n flow control valves, x.

The fixed and floating bottom hole pressure oil production optimization function may be shown as follows. In one or more embodiments, one of two functions may be used. The two functions include (i) a simple fiscal calculation based upon the price of oil and the cost of producing gas and/or water and (ii) a penalty function formulation in which oil production is penalized by gas and/or water production based upon a power law relationship.

The fiscal objective function is shown in equations (7) and (8).

$$f(x) = -\sum_{i=1}^{n} K_i(PO_i - C^g G_i - C^w W_i) \tag{7}$$

$$K_i = \frac{\sum_{j=1}^{m} k_{i,j}}{\sum_{i=1}^{n}\sum_{j=1}^{m} k_{i,j}} \tag{8}$$

where:

P=Oil price $C^g$=Cost of gas processing $C^w$=Cost of water processing $O_i$=Surface oil production rate for device $G_i$=Surface gas production rate for device $W_i$=Surface water production rate for device $K_i$=Permeability correction factor for device $k_{i,j}$=permeability thickness for connection between reservoir model grid structure and device Equation (7) represents the objective function which is a function of the set fractional openings of the set of n flow control valves, x. Equation (8) represents the correction factor which is applied to each flow control valve, where each flow control valve is connected to the reservoir model grid structure by a set of m connections.

The rate penalty objective function may be calculated using equations (9), (10), (11), (12), (13), and (14):

$$f(x) = L(1 - P) \tag{9}$$

$$P = W^g P^g + (1 - W^g)P^w \tag{10}$$

$$P^g = a\left(\frac{GOR - GOR_{min}}{GOR_{max} - GOR_{min}}\right)^b \tag{11}$$

$$P^w = a\left(\frac{WC - WC_{min}}{WC_{max} - WC_{min}}\right)^b \tag{12}$$

$$GOR = \sum_{i=1}^{n} \frac{\propto_i G_i}{O_i} \tag{13}$$

$$WC = \sum_{i=1}^{n} \frac{\propto_i W_i}{L_i} \tag{14}$$

where:

L=Liquid production rate for the well $P^g$=Penalty for gas production $P^w$=Penalty for water production $W^g$=Fractional phase weighting for the gas phase a=Penalty multiplier b=Penalty exponent GOR=Weighted GOR for all devices WC=Weighted water cuts for all devices $\propto_i$=Weighting factor (bias) for device In the above equations, the devices are the flow control devices. Further, the superscripts g and w are for gas or water, respectively, while i and j are to iterate through the devices. Subscripts, max and min, refer to the maximum and minimum value for the corresponding variable. Further, a and b are empirical constants, the specified penalties may be determined through trial and error via experiments, the fractional phase weightings are linear weighting terms. The users may override the fractional phase weightings. the values of $G_i$, $O_{i\ i}$, and $W_i$ may be predicted by the reservoir simulations.

Figure 5:
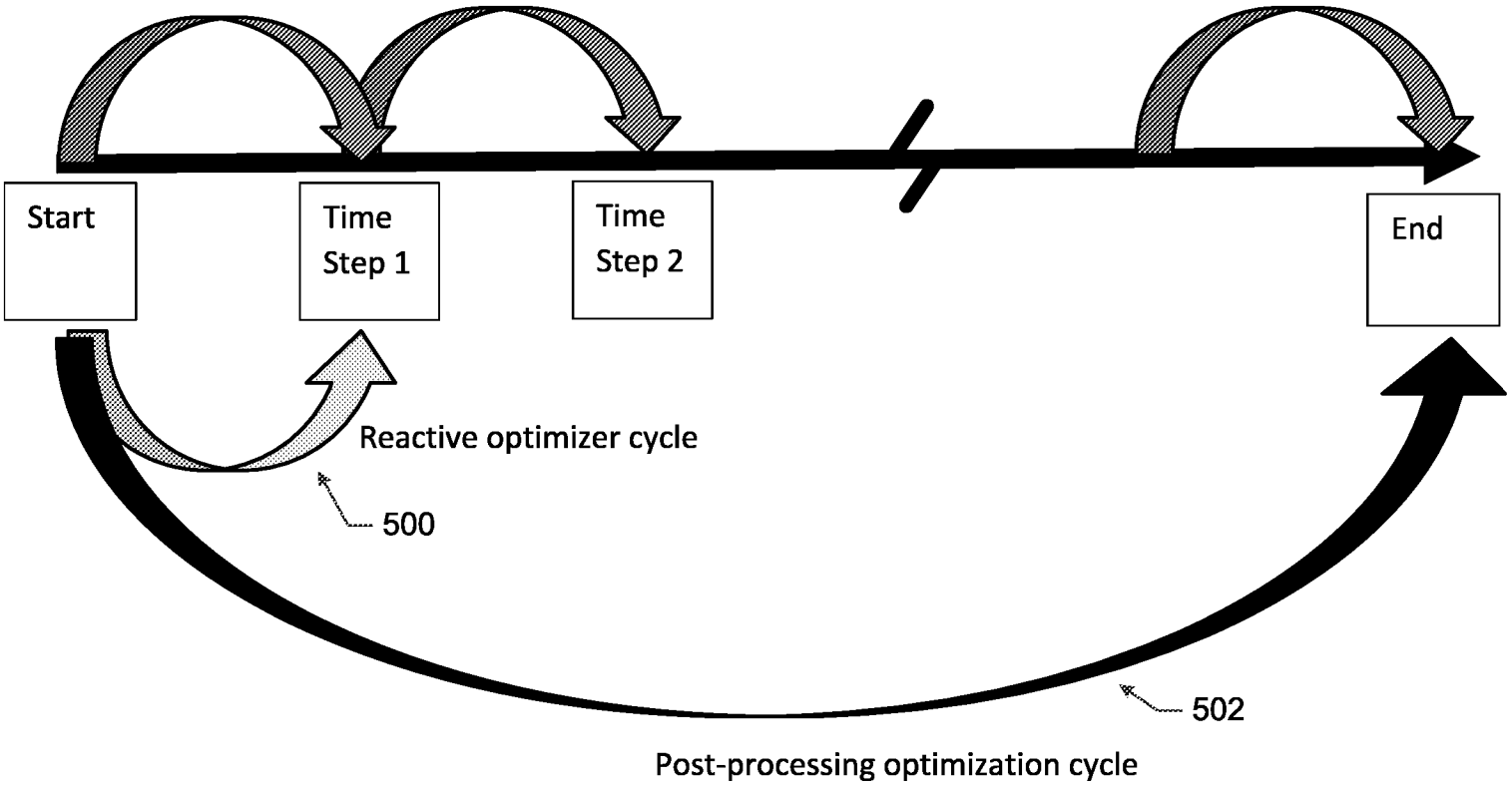
FIG. 5 shows an example in accordance with disclosed embodiments.

The following example is for explanatory purposes only and not intended to limit the scope of the disclosed embodiments. Turning to FIG. 5, efficiency of the reactive completion device optimization algorithm stems from the fact that the reactive completion device optimization function is implemented within the simulator based on an instantaneous objective function. Conventionally, device setting optimization is performed by post-simulation analysis with a global objective function. The reason for gains in efficiency of one or more embodiments is due to the significant reduction of parameters at the optimization steps. For example, consider a simulation case in which 5 devices are defined with the objective of maximizing the Net Present Value based on monthly update of the devices. In a period of 12 months, post-processing optimizers need to handle 60 (5×12) variables. One or more embodiments reduce the problem by handling only 5 variables at an optimization time.

Additionally, the reactive completion device optimization cycle is short as the optimization is implemented at the time-step level as shown by arrow (500) compared to conventional optimization routines with post simulation analysis as shown by arrow (502). Hence, a single simulation run is performed to implement the reactive completion device optimization whereas conventional optimization methods require to simulation cases multiple times to explore the parameter space and perform optimization.

Figure 6:
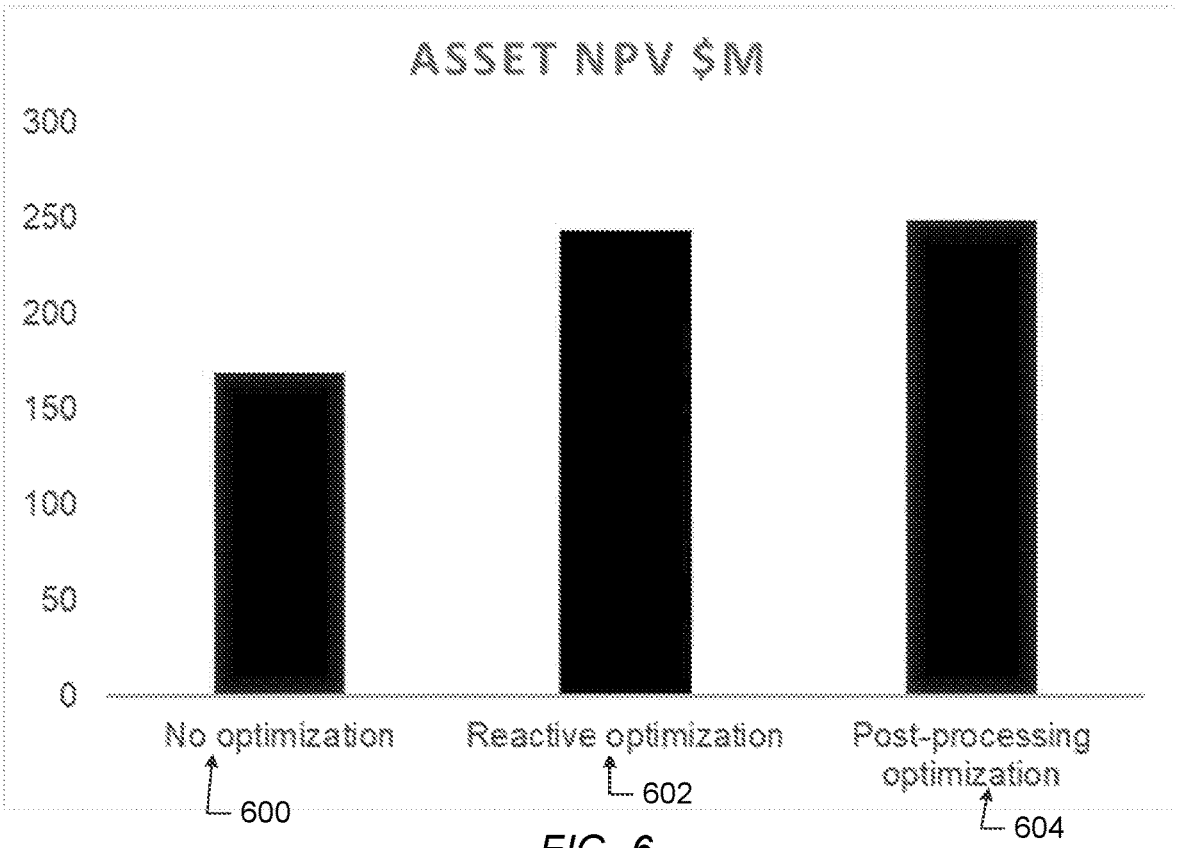
FIG. 6 shows an example in accordance with disclosed embodiments.
Figure 7:
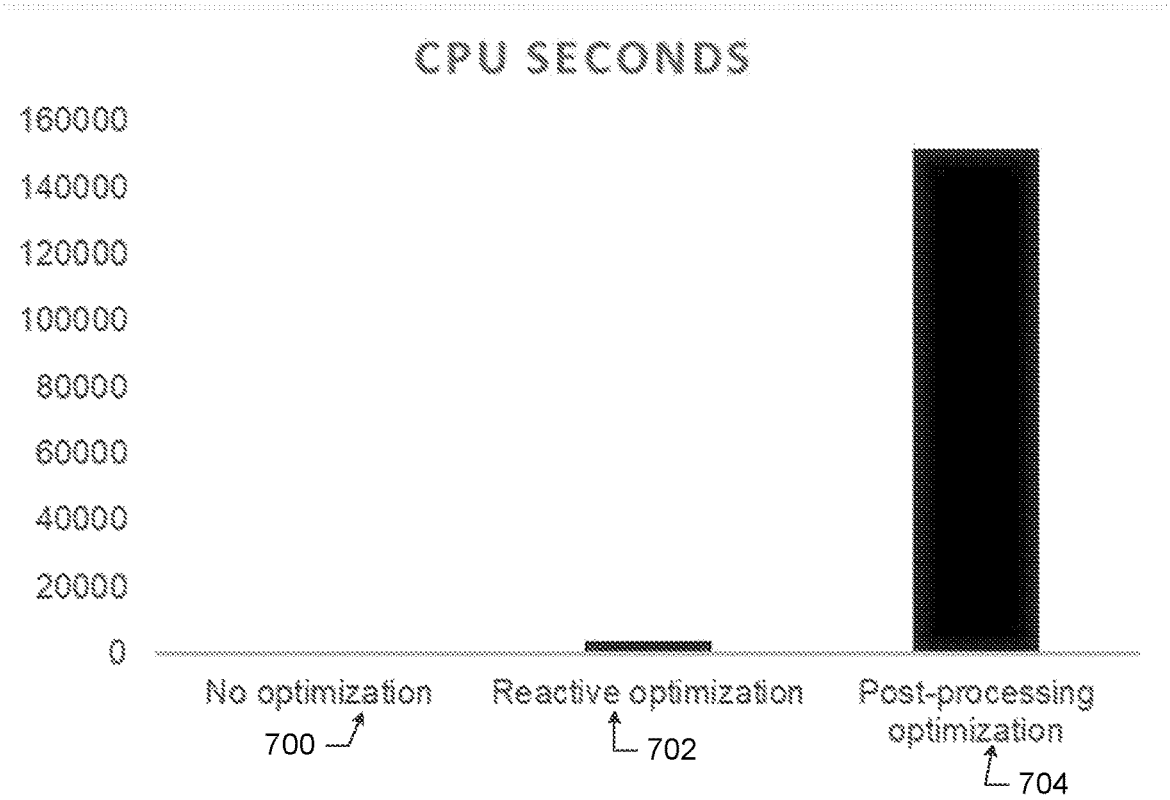
FIG. 7 shows an example in accordance with disclosed embodiments.

Turning to FIGS. 6 and 7, FIGS. 6 and 7 are charts of benchmarks operations. In a benchmark examples, three cases were run to evaluate the reactive completion optimization efficiency. The benchmark cases include a base case run without optimization (600 in FIGS. 6 and 700 in FIG. 7), a reactive optimization (602 in FIGS. 6 and 702 in FIG. 7) in accordance with disclosed embodiments, and a post processing optimization (604 in FIGS. 6 and 704 in FIG. 7). The results are shown in FIGS. 6 and 7. As shown, reactive optimization case provides similar results to that of post-processing optimization using only two percent of the computational cost.

Embodiments of the invention may be implemented on a computing system. Any combination of mobile, desktop, server, router, switch, embedded device, or other types of hardware may be used. For example, as shown in FIG. 8.1, the computing system (800) may include one or more computer processors (802), non-persistent storage (804) (e.g., volatile memory, such as random access memory (RAM), cache memory), persistent storage (806) (e.g., a hard disk, an optical drive such as a compact disk (CD) drive or digital versatile disk (DVD) drive, a flash memory, etc.), a communication interface (812) (e.g., Bluetooth interface, infrared interface, network interface, optical interface, etc.), and numerous other elements and functionalities.

The computer processor(s) (802) may be an integrated circuit for processing instructions. For example, the computer processor(s) may be one or more cores or micro-cores of a processor. The computing system (800) may also include one or more input devices (810), such as a touchscreen, keyboard, mouse, microphone, touchpad, electronic pen, or any other type of input device.

The communication interface (812) may include an integrated circuit for connecting the computing system (800) to a network (not shown) (e.g., a local area network (LAN), a wide area network (WAN) such as the Internet, mobile network, or any other type of network) and/or to another device, such as another computing device.

Further, the computing system (800) may include one or more output devices (808), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (802), non-persistent storage (804), and persistent storage (806). Many different types of computing systems exist, and the aforementioned input and output device(s) may take other forms.

Software instructions in the form of computer readable program code to perform embodiments of the invention may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the invention.

The computing system (800) in FIG. 8.1 may be connected to or be a part of a network. For example, as shown in FIG. 8.2, the network (820) may include multiple nodes (e.g., node X (822), node Y (824)). Each node may correspond to a computing system, such as the computing system shown in FIG. 8.1, or a group of nodes combined may correspond to the computing system shown in FIG. 8.1. By way of an example, embodiments of the invention may be implemented on a node of a distributed system that is connected to other nodes. By way of another example, embodiments of the invention may be implemented on a distributed computing system having multiple nodes, where each portion of the invention may be located on a different node within the distributed computing system. Further, one or more elements of the aforementioned computing system (800) may be located at a remote location and connected to the other elements over a network.

Although not shown in FIG. 8.2, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (e.g., node X (822), node Y (824)) in the network (820) may be configured to provide services for a client device (826). For example, the nodes may be part of a cloud computing system. The nodes may include functionality to receive requests from the client device (826) and transmit responses to the client device (826). The client device (826) may be a computing system, such as the computing system shown in FIG. 8.1. Further, the client device (826) may include and/or perform all or a portion of one or more embodiments of the invention.

The computing system or group of computing systems described in FIGS. 8.1 and 8.2 may include functionality to perform a variety of operations disclosed herein. For example, the computing system(s) may perform communication between processes on the same or different system. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided below.

Based on the client-server networking model, sockets may serve as interfaces or communication channel endpoints enabling bidirectional data transfer between processes on the same device. Foremost, following the client-server networking model, a server process (e.g., a process that provides data) may create a first socket object. Next, the server process binds the first socket object, thereby associating the first socket object with a unique name and/or address. After creating and binding the first socket object, the server process then waits and listens for incoming connection requests from one or more client processes (e.g., processes that seek data). At this point, when a client process wishes to obtain data from a server process, the client process starts by creating a second socket object. The client process then proceeds to generate a connection request that includes at least the second socket object and the unique name and/or address associated with the first socket object. The client process then transmits the connection request to the server process. Depending on availability, the server process may accept the connection request, establishing a communication channel with the client process, or the server process, busy in handling other operations, may queue the connection request in a buffer until server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (e.g., bytes).

Shared memory refers to the allocation of virtual memory space in order to substantiate a mechanism for which data may be communicated and/or accessed by multiple processes. In implementing shared memory, an initializing process first creates a shareable segment in persistent or non-persistent storage. Post creation, the initializing process then mounts the shareable segment, subsequently mapping the shareable segment into the address space associated with the initializing process. Following the mounting, the initializing process proceeds to identify and grant access permission to one or more authorized processes that may also write and read data to and from the shareable segment. Changes made to the data in the shareable segment by one process may immediately affect other processes, which are also linked to the shareable segment. Further, when one of the authorized processes accesses the shareable segment, the shareable segment maps to the address space of that authorized process. Often, only one authorized process may mount the shareable segment, other than the initializing process, at any given time.

Other techniques may be used to share data, such as the various data described in the present application, between processes without departing from the scope of the invention. The processes may be part of the same or different application and may execute on the same or different computing system.

Rather than or in addition to sharing data between processes, the computing system performing one or more embodiments of the invention may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the user's selection.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the user's selection. Further to the above example, the data received from the server after selecting the URL link may provide a web page in Hyper Text Markup Language (HTML) that may be rendered by the web client and displayed on the user device.

Once data is obtained, such as by using techniques described above or from storage, the computing system, in performing one or more embodiments of the invention, may extract one or more data items from the obtained data. For example, the extraction may be performed as follows by the computing system in FIG. 8.1. First, the organizing pattern (e.g., grammar, schema, layout) of the data is determined, which may be based on one or more of the following: position (e.g., bit or column position, Nth token in a data stream, etc.), attribute (where the attribute is associated with one or more values), or a hierarchical/tree structure (consisting of layers of nodes at different levels of detail-such as in nested packet headers or nested document sections). Then, the raw, unprocessed stream of data symbols is parsed, in the context of the organizing pattern, into a stream (or layered structure) of tokens (where each token may have an associated token "type").

Next, extraction criteria are used to extract one or more data items from the token stream or structure, where the extraction criteria are processed according to the organizing pattern to extract one or more tokens (or nodes from a layered structure). For position-based data, the token(s) at the position(s) identified by the extraction criteria are extracted. For attribute/value-based data, the token(s) and/or node(s) associated with the attribute(s) satisfying the extraction criteria are extracted. For hierarchical/layered data, the token(s) associated with the node(s) matching the extraction criteria are extracted. The extraction criteria may be as simple as an identifier string or may be a query presented to a structured data repository (where the data repository may be organized according to a database schema or data format, such as XML).

The extracted data may be used for further processing by the computing system. For example, the computing system of FIG. 8.1, while performing one or more embodiments of the invention, may perform data comparison. Data comparison may be used to compare two or more data values (e.g., A, B). For example, one or more embodiments may determine whether A>B, A=B, A!=B, A<B, etc. The comparison may be performed by submitting A, B, and an opcode specifying an operation related to the comparison into an arithmetic logic unit (ALU) (i.e., circuitry that performs arithmetic and/or bitwise logical operations on the two data values). The ALU outputs the numerical result of the operation and/or one or more status flags related to the numerical result. For example, the status flags may indicate whether the numerical result is a positive number, a negative number, zero, etc. By selecting the proper opcode and then reading the numerical results and/or status flags, the comparison may be executed. For example, in order to determine if A>B, B may be subtracted from A (i.e., A−B), and the status flags may be read to determine if the result is positive (i.e., if A>B, then A−B>0). In one or more embodiments, B may be considered a threshold, and A is deemed to satisfy the threshold if A=B or if A>B, as determined using the ALU. In one or more embodiments of the invention, A and B may be vectors, and comparing A with B requires comparing the first element of vector A with the first element of vector B, the second element of vector A with the second element of vector B, etc. In one or more embodiments, if A and B are strings, the binary values of the strings may be compared.

The computing system in FIG. 8.1 may implement and/or be connected to a data repository. For example, one type of data repository is a database. A database is a collection of information configured for ease of data retrieval, modification, re-organization, and deletion. Database Management System (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (e.g. join, full join, count, average, etc.), sort (e.g. ascending, descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 8.1 may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The above description of functions present only a few examples of functions performed by the computing system of FIG. 8.1 and the nodes and/or client device in FIG. 8.2. Other functions may be performed using one or more embodiments of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method comprising:

i) obtaining a reservoir model for a subsurface reservoir and associated wellbore;

ii) identifying a current state of the wellbore by running a reservoir simulator using the reservoir model of i);

iii) selecting, by a computer processor, a particular optimization function from a plurality of optimization functions according to the current state of the wellbore of ii), wherein the plurality of optimization functions are assigned to distinct states of the wellbore, and the particular optimization function is assigned to the current state of the wellbore of ii);

iv) calculating, by the computer processor, a plurality of valve positions of a plurality of physical devices using the particular optimization function selected in iii); and v) implementing the plurality of valve positions of iv).

2. The method of claim 1, wherein the plurality of optimization functions includes at least one optimization function selected from the group consisting of:

a first optimization function having an objective function to maximize oil production without equalizing flowrates through the plurality of physical devices, wherein the first optimization function is assigned to a first state of the wellbore where a minimum bottom hole pressure limit is reached, and wherein the first optimization function is selected as the particular optimization function in iii) for the case that the first state of the wellbore where the minimum bottom hole pressure limit is reached is identified in ii);

a second optimization function having an objective function to maximize oil production without equalizing flowrates through the plurality of physical devices, wherein the second optimization function is assigned to a second state of the wellbore where a minimum bottom hole pressure limit is reached and the bottom hole pressure can be increased, and wherein the second optimization function is selected as the particular optimization function in iii) for the case that the second state of the wellbore where the minimum bottom hole pressure limit is reached and the bottom hole pressure can be increased is identified in ii);

a third optimization function having an objective function to maximize oil production without equalizing flowrates through the plurality of physical devices, wherein the third optimization function is assigned to a third state of the wellbore where gas-oil ratio and water cut limits have not been reached, and wherein the third optimization function is selected as the particular optimization function in iii) for the case that the third state of the wellbore where gas-oil ratio and water cut limits have not been reached is identified in ii); and a fourth optimization function having an objective function to maximize oil production while equalizing flowrates through the plurality of physical devices, wherein the fourth optimization function is assigned to a fourth state of the wellbore, and wherein the fourth optimization function is selected as the particular optimization function in iii) for the case that the fourth state of the wellbore is identified in ii).

3. The method of claim 2, wherein:

the first optimization function is configured to calculate the plurality of valve positions to minimize a gas and water production using a fixed bottom hole pressure.

4. The method of claim 2, wherein:

the first optimization function is configured to force a bottom hole pressure to a fixed value.

5. The method of claim 2, wherein:

the second optimization function is configured to calculate the plurality of valve positions to minimize a gas and water production using a variable bottom hole pressure.

6. The method of claim 2, wherein:

the fourth state of the wellbore corresponds to satisfaction of a trigger condition.

7. The method of claim 6, wherein the trigger condition is selected from a group consisting of gas oil ratio and water cut.

8. The method of claim 1, further comprising:

receiving physical device constraints of the plurality of physical devices, wherein calculating the plurality of valve positions of iv) is performed according to the physical device constraints.

9. The method of claim 1, wherein:

the implementing the plurality of valve positions of v) involves calculating a subsequent state of the subsurface reservoir using the plurality of valve positions.

10. A system comprising:

a data repository comprising a reservoir model for a subsurface reservoir and associated wellbore;

a computer processor;

a reservoir simulator configured to execute on the computer processor to cause the computer processor to:

i) obtain the reservoir model;

ii) identify a current state of the wellbore using the reservoir model of i); and a completion application configured to execute on the computer processor to cause the computer processor to:

iii) select a particular optimization function from a plurality of optimization functions according to the current state of the wellbore of ii), wherein the plurality of optimization functions are assigned to distinct states of the wellbore, and the particular optimization function is assigned to the current state of the wellbore of ii); and iv) calculate a plurality of valve positions of a plurality of physical devices using the particular optimization function selected in iii) for implementing the plurality of valve positions.

11. The system of claim 10, wherein the plurality of valve positions of iv) are implemented by the reservoir simulator using a subsequent timestep of a reservoir simulation.

12. The system of claim 10, wherein:

the plurality of physical devices are located at the oilfield, and the plurality of valve positions of iv) are implemented by sending a signal to the plurality of physical devices to adjust the plurality of valve positions.

13. A computer program product comprising computer readable program code for causing a computer system to perform operations, the operations comprising:

i) obtaining a reservoir model for a subsurface reservoir and associated wellbore;

ii) identifying a current state of the wellbore by running a reservoir simulator using the reservoir model of i);

iii) selecting, by a computer processor, an optimization function from a plurality of optimization functions according to the current state of the wellbore of ii), wherein the plurality of optimization functions are assigned to distinct states of the wellbore, and the particular optimization function is assigned to the current state of the wellbore of ii);

iv) calculating, by the computer processor, a plurality of valve positions of a plurality of physical devices using the particular optimization function selected in iii); and v) implementing the plurality of valve positions of iv).

14. The computer program product of claim 13, wherein the plurality of optimization functions includes at least one optimization function selected from the group consisting of:

a first optimization function having an objective function to maximize oil production without equalizing flowrates through the plurality of physical devices, wherein the first optimization function is assigned to a first state of the wellbore where a minimum bottom hole pressure limit is reached, and wherein the first optimization function is selected as the particular optimization function in iii) for the case that the first state of the wellbore where the minimum bottom hole pressure limit is reached is identified in ii);

a second optimization function having an objective function to maximize oil production without equalizing flowrates through the plurality of physical devices, wherein the second optimization function is assigned to a second state of the wellbore where a minimum bottom hole pressure limit is reached and the bottom hole pressure can be increased, and wherein the second optimization function is selected as the particular optimization function in iii) for the case that the second state of the wellbore where the minimum bottom hole pressure limit is reached and the bottom hole pressure can be increased is identified in ii);

a third optimization function having an objective function to maximize oil production without equalizing flowrates through the plurality of physical devices, wherein the third optimization function is assigned to a third state of the wellbore where gas-oil ratio and water cut limits have not been reached, and wherein the third optimization function is selected as the particular optimization function in iii) for the case that the third state of the wellbore where gas-oil ratio and water cut limits have not been reached is identified in ii); and a fourth optimization function having an objective function to maximize oil production while equalizing flowrates through the plurality of physical devices, wherein the fourth optimization function is assigned to a fourth state of the wellbore, and wherein the fourth optimization function is selected as the particular optimization function in iii) for the case that the fourth state of the wellbore is identified in ii).

15. The computer program product of claim 14, wherein:

the first optimization function is configured to calculate the plurality of valve positions to minimize a gas and water production using a fixed bottom hole pressure.

16. The computer program product of claim 14, wherein:

the first optimization function is configured to force a bottom hole pressure to fixed value.

17. The computer program product of claim 14, wherein:

the second optimization function is configured to calculate the plurality of valve positions to minimize a gas and water production using a variable bottom hole pressure.

18. The computer program product of claim 14, wherein:

the fourth state of the wellbore corresponds to satisfaction of a trigger condition.

19. The computer program product of claim 18, wherein the trigger condition is selected from a group consisting of gas oil ratio and water cut.

20. The computer program product of claim 13, wherein the operations further comprise:

receiving physical device constraints of the plurality of physical devices, wherein calculating the plurality of valve positions of iv) is performed according to the physical device constraints.

* * * * *